United States Patent [19]

Zingg

[11] 3,995,839

[45] Dec. 7, 1976

[54] APPARATUS AND METHOD FOR WETTING DRY PARTICLES AND DISPERSING THE PARTICLES IN A LIQUID

[75] Inventor: Warren M. Zingg, Tulsa, Okla.

[73] Assignee: The Dow Chemical Company, Midland, Mich.

[22] Filed: Nov. 28, 1975

[21] Appl. No.: 636,239

[52] U.S. Cl. ..... 259/22; 259/7

[51] Int. Cl.[2] ..... B01F 5/18; B01F 5/26

[58] Field of Search ..... 259/4 R, 5–10, 259/18–27

[56] References Cited

UNITED STATES PATENTS

| | | | |
|---|---|---|---|
| 3,051,454 | 8/1962 | Goos et al. | 259/23 X |
| R27,681 | 6/1973 | Gaddis | 259/18 |

FOREIGN PATENTS OR APPLICATIONS

| | | | |
|---|---|---|---|
| 815,247 | 4/1937 | France | 259/18 |

*Primary Examiner*—Leonard D. Christian
*Assistant Examiner*—Alan Cantor
*Attorney, Agent, or Firm*—V. Dean Clausen

[57] ABSTRACT

Disclosed is an apparatus and method for wetting dry particles and dispersing the particles in a liquid. The dry particles are delivered onto a vibrating tray, which has a circular discharge opening therein and a circular plate secured to the tray below the opening. Positioned below the tray is a closed container, which includes a body of liquid and an opening in the container lid for receiving the vibrating plate member. A vertical conduit section in the container has an open end positioned above the liquid surface and directly below the plate member.

In a typical operation, a liquid stream under pressure passes upwardly in the vertical conduit and discharges in the form of a circular spout. From the tray the particles fall onto the vibrating plate member, and then downwardly, in a circular curtain pattern, into the liquid spout. In practice, the dry particles will strike the liquid just beyond the apogee of the spout. This enables the particles to move on a downward vector, along with the liquid, so that good wetting and dispersing are achieved. The apparatus has particular utility in wetting and dispersing dry particles which are difficult to solubilize, such as polymeric flocculating agents.

6 Claims, 4 Drawing Figures

APPARATUS AND METHOD FOR WETTING DRY PARTICLES AND DISPERSING THE PARTICLES IN A LIQUID

BACKGROUND OF THE INVENTION

Broadly, the invention relates to wetting dry particles and dispersing the particles in a liquid. More specifically, the dry particles are wetted by dropping them into a liquid spout, and the spout carries the particles into an agitating liquid in which they are dispersed.

A line of high-molecular-weight, synthetic, water-soluble polymers are widely used as flocculating agents in the mining, pulp and paper, and chemical industries. One group of commercially available flocculating agents, which are sold under the name Separan, are comprised of polymers of acrylamide. In the use of these polymeric flocculating agents, it is a major problem to dissolve the dry particles in water. Problems have also been encountered in trying to dissolve certain types of clays, starches and natural gums in water or other liquids.

Referring particularly to the polymeric flocculating materials, in the dissolving operation the wetted particles have a tendency to agglomerate and form clumps. On the outer surfaces of each clump a gelatin-like layer is formed. The gelatin layer prevents wetting of the inner particles until the clump is dispersed in water, or some other solubilizing liquid. The sticky clumps are also difficult to handle because they frequently will plug up the mixing equipment.

Handling of the dry polymeric particles also presents another problem. Because of the extremely small size of the particles, they will frequently generate dust which is hazardous to breathe. In addition, the dust is a hygroscopic material which will combine with atmospheric moisture and form sticky coatings on walkways and equipment.

There are several known metods and apparatus for wetting and dispersing polymeric materials in a liquid medium. An example of a recent development in the art is the apparatus and method described in U.S. Pat. No. Re. 27681, to P. G. Gaddis.

SUMMARY OF THE INVENTION

In the apparatus of this invention the dry particles are stored in a hopper, which includes a discharge outlet. The hopper outlet communicates with one end of an enclosed feeder tray. On the opposite end of the feeder tray is a discharge opening. A plate member is secured to the feeder tray immediately below the discharge opening.

Positioned below the feeder tray is a container, which includes a closure with an opening therein. A body of liquid is flowed through the container and the opening in the container closure allows the plate member to fit inside the closure opening. A vibrator unit attached to the feeder tray provides means for vibrating the tray and the plate member. A mixer device is positioned in the liquid in the container. The mixer provides means for agitating the liquid.

The present apparatus includes a circular conduit member which has a vertical section therein. The vertical section has an upper end which is open and a deflector member is located inside the open end. The vertical section is positioned inside the container, such that the deflector member is located directly below the center of the plate member on the feeder tray. In addition, the conduit member is filled with a liquid stream under pressure.

In a typical operation of the apparatus, the dry particles in the hopper are delivered into the vibrating feeder tray. In the feeder tray, the particles drop through the discharge opening and onto the plate member. At the same time the particles are being discharged from the feeder tray onto the plate member, the liquid stream in the conduit member flows upwardly in the vertical section to strike the deflector member. The deflected stream forms a circular liquid spout which falls back into the agitating liquid in the container. From the vibrating plate member the particles fall downwardly in a curtain pattern and strike the liquid spout. The spout wets the particles and carries them downwardly into the agitating liquid in the container. The particles are then dispersed in the agitating liquid by the mixer device.

DESCRIPTION OF A PREFERRED EMBODIMENT

Figure 1:
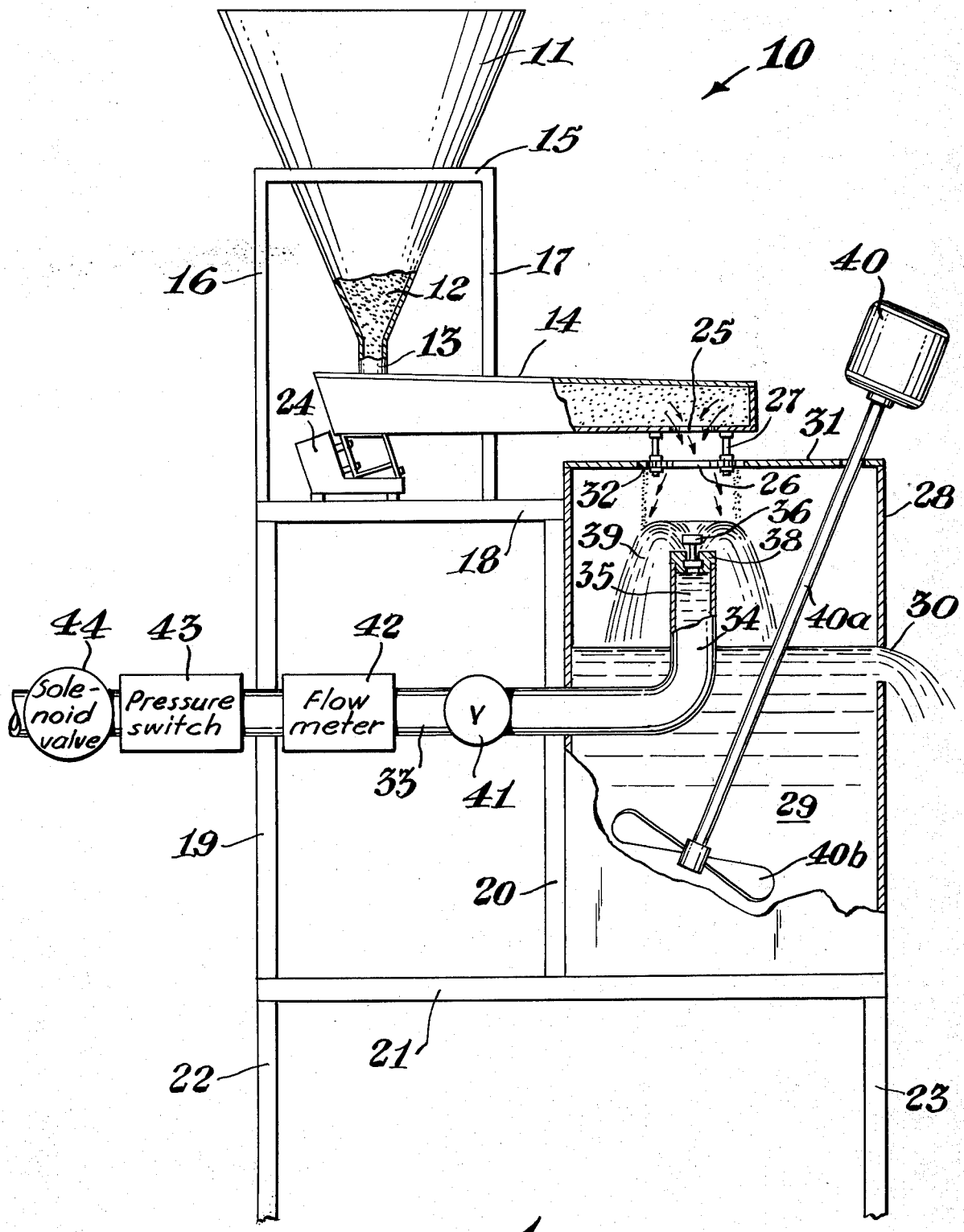
FIG. 1 is a side elevation view, partly in section, of an apparatus according to this invention, for wetting dry particles and dispersing the particles in a liquid.

In the drawing, referring particlarly to FIG. 1, the numeral 10 indicates a wetting and dispersing apparatus according to this invention. At the top of apparatus 10 is a hopper 11, in which a charge of dry particles 12 is stored. Hopper 11 includes an outlet 13 which seats down into one end of an enclosed feeder tray 14. Outlet 13 provides means for discharging the dry particles 12 into tray 14.

Hopper 13 is supported in an upright frame, the frame including a cross member 15 and leg members 16 and 17. In turn, the leg members 16 and 17 are secured to the cross member 18 of a second upright frame. The second frame also includes leg members 19 and 20. A third upright frame is defined by a cross member 21 and leg members 22 and 23. The leg members 19 and 20 of the second frame are fastened to the cross member 21 of the lower frame.

Figure 2:
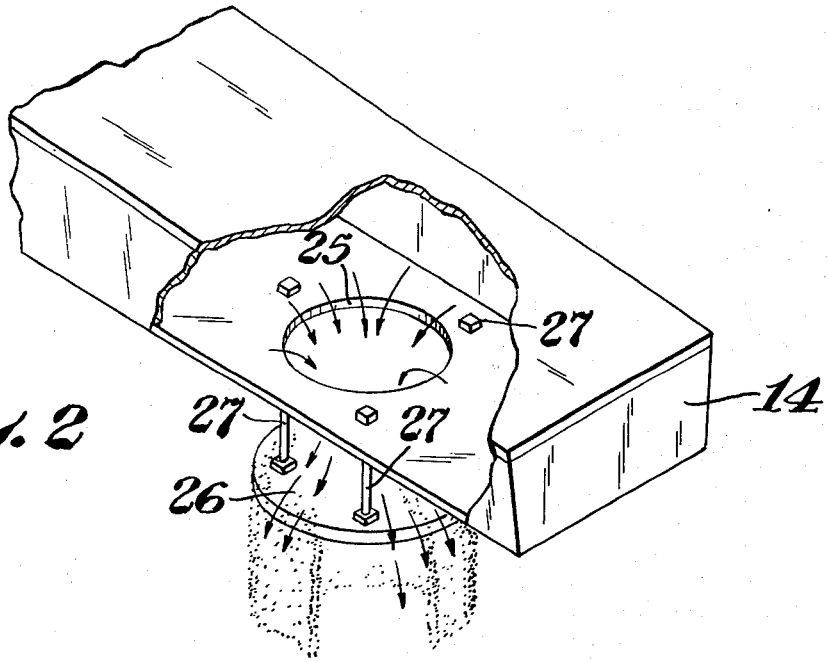
FIG. 2 is an enlarged fragmentary perspective view, partly in section, which illustrates the discharge end of a feeder tray. The feeder tray is one component of the apparatus shown in FIG. 1.

A vibrator unit 24 is attached to the underside of feeder tray 14 at the "feed" end of the tray. At the opposite end of tray 14 is a discharge opening 25. As best shown in FIG. 2, a plate member 26 is fastened to tray 14 by several bolt fasteners, each bolt indicated by numeral 27. The plate member 26 is fastened to tray 14 such that the plate is positioned directly below the discharge opening 25. In the practice of this invention it is preferred that the discharge opening 25 and the plate member 26 have a circular shape. As indicated in the drawing, particularly FIG. 2, the plate member 26 is slightly larger than the discharge opening 25.

A container 28 is positioned under the "discharge" end of feeder tray 14. During a given operation of the apparatus 10, the container 28 will include a body of liquid 29. An opening 30 in the side wall of container 28 provides an outlet for the liquid 29 to discharge into a holding tank (not shown). The outflow of liquid 29 through opening 30 creates a draft within container 28. This induced draft has a useful purpose which is explained in more detail later in this text. Container 28 is closed at the top by a lid closure 31, which has an opening 32 therein. As shown in FIG. 1, the plate member 26 fits within the opening 32. In the usual operating position the top surface of plate 26 will be flush with the top surface of lid 31.

Figure 4:
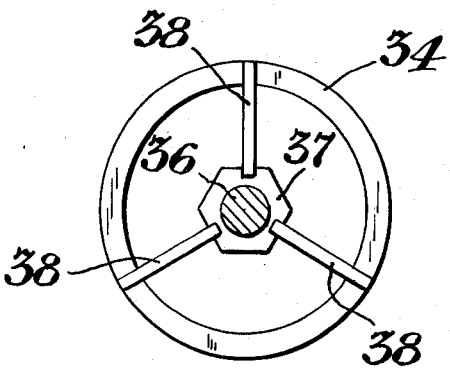
FIG. 4 is a cross section view of the vertical conduit section of FIG. 3, taken on line 4—4.
Figure 3:
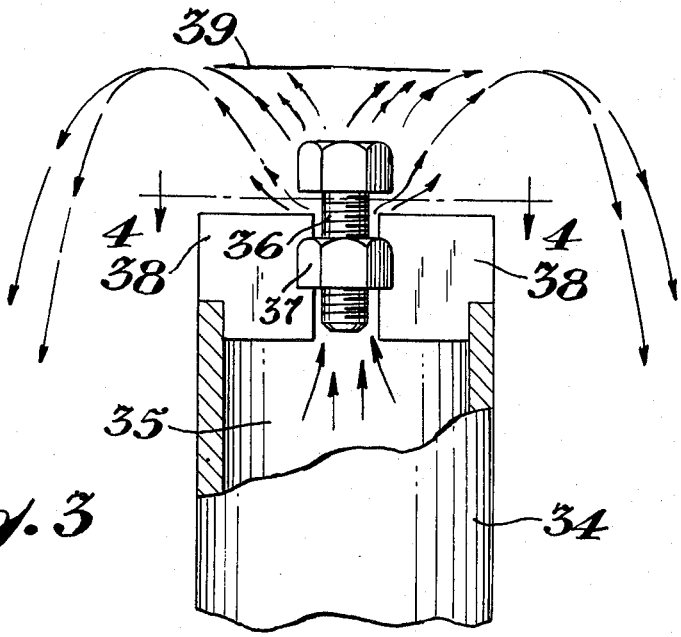
FIG. 3 is an enlarged fragmentary front elevation view, partly in section, which illustrates the upper end of the vertical section of a conduit member. The vertical conduit section is another component of the apparatus shown in FIG. 1.

Another component of the apparatus 10 is a cicular conduit member 33, which includes a vertical section 34. The upper end of vertical conduit section 34 is open, as best shown in FIGS. 3 and 4 of the drawing. During a given operation of the apparatus 10 a liquid stream 35, which is under pressure, is contained within the conduit 33 and vertical section 34. Fastened inside the upper end of the vertical section 34 is a deflector member 36. Preferably, the deflector 36 is defined by a circular pin with a cap thereon. A particularly suitable structure for the deflector 36 is provided by a cap screw with a hexagon head. The cap screw 36 is threaded into a hexagon nut 37, the nut being centered in conduit section 34. Means for positioning and fastening the nut 37 in the center of cross section 34 are provided by several spider members, as indicated by numeral 38.

As shown in FIGS. 1 and 3, the liquid stream 35 is moving in a vertical direction (upwardly) when it discharges from the upper end of vertical section 34. The purpose of cap screw 36 is to deflect the discharging stream, such that it will assume an oblique or diagonal direction. When gravitational force overtakes the discharging stream, it will revert from the oblique direction to a vertical direction. As indicated in the drawing, the net effect is a circular liquid spout 39, the spout resembling a fountain which falls into the liquid 29 in container 28.

A mixer device which includes a motor 40, a shaft 40*a*, and a propeller-type blade 40*b*, is positioned in the liquid 29 in container 28. The mixer unit provides means for agitating the liquid 29. The reason for agitating the liquid 29 is to enhance the dissolving of the particles 12 in the liquid, which is explained in more detail later in this description. The conduit member 33 includes a control valve 41, a flow meter 42, a pressure switch 43, and a solenoid valve 44. The function of these devices, with regard to the liqid introduced into conduit 33, is explained more fully later in this description.

A typical operation of the apparatus 10 will now be described to illustrate the practice of this invention. For the operation described herein the dry particles 12 are commercially available flocculating agents, as described earlier, which comprise polymers of acrylamide. The objective is to wet the dry particles and disperse them in a water medium. The first step is to start the water flowing in conduit member 33 and vertical section 34 to provide the water spout 39. To initiate the water flow, the solenoid valve 44 must be open.

Solenoid valve 44 is electrically connected into a level control switch, which is installed on a holding tank positioned immediately below the orifice 30 in container 28. The holding tank and level control switch are not shown in the drawing. In a typical operation, the liquid dispersion in the holding tank is being delivered to a use point. As the level of liquid in the holding tank recedes, it will trip the level control switch at a certain point and close a circuit to solenoid valve 44. This action causes the solenoid to open valve 44 and thus start the water flow into conduit member 33.

At the same time the water flow is started in conduit member 33, the mixer device is turned on by manually closing a switch on the motor 40. As the water flows through valve 44 it exerts a pressure against a diaphragm in switch 43. The diaphragm thus closes the switch 43 to complete a circuit to vibrator unit 24. The electrical connection from switch 43 to vibrator 24 is not shown. The activation of vibrator unit 24 causes the feeder tray 24 to vibrate, so that the dry particles 12 continuously move toward the discharge opening 25. As the particles 12 drop through opening 25 they collect on the plate member 26.

Since the plate member 26 is continuously vibrating, the dry particles 12 continuously move to the periphery of the plate and fall downwardly toward the water spout 39. The downwardly falling particles define a circular curtain pattern, since they are continuously dropping from the periphery of the plate at all points. As the particles 12 drop from the plate 26 toward spout 39, they are subject to an induced draft in container 28. This draft, which is created by the discharge of the liquid 29 through opening 30, prevents the particles 12 from being carried into the surrounding atmosphere.

As best shown in FIG. 1, the dry particles 12 strike the liquid in spout 39 at a point immediately beyond the crest, or apogee, of the spout. In the practice of this invention, the angle at which the particles strike the liquid is critical to the proper wetting of the particles. As a specific example, this angle should be not less than about 10° and not more than about 20°. For best results, it is preferred that the strike angle of the particles be about 15°.

The fact that the particles must strike the water at an acute angle to give good wetting of the particles might be explained as follows. The dry particles falling from the plate member 26 are moving in a vertical direction, that is, they are on a downward vector. Also, at the point where the particles strike the liquid, the liquid is moving on a downward vector. In this situation, therefore, the particles are not colliding with the liquid. To explain further, I have found that where there is a direct collision of the particles with the wetting liquid, the particles will skip or bounce off of the wetting surface.

The dry particles 12 which strike the water spout 39, are wetted by the liquid in the spout and carried down into the liquid 29 in container 28. In liquid 29 the particles are dispersed by the mixer device and the dispersion is discharged into the holding tank through the orifice 30.

Regarding the flow meter 42, the function of this meter is to measure the amount of liquid which goes into the dispersion. By relating this figure (liquid) to the amount of dry material used, the operator can calculate the concentration of solids in the dispersion. The valve 41 is a throttling valve, which is operated manually to regulate the liquid flow to the vertical conduit section 34. The objective is to be able to control liquid flow in conduit 33 at a desirable level, regardless of line pressure. The valve 41 thus enables the operator to control the shape and size of the spout to give the best wetting characteristics. Suitable valves for this purpose are globe valves, plug valves, or ball valves.

The invention claimed is:

1. An apparatus for wetting dry particles and dispersing the particles in a liquid, including the combination of:

a hopper for storing dry particles, the hopper including a charge of dry particles and an outlet for discharging the dry particles;

an enclosed feeder tray which communicates at one end with the hopper discharge outlet, which has a discharge opening at the opposite end of the tray, and which has a plate member secured to the tray, the plate member being positioned directly below the discharge opening;

a container which has a closure with an opening therein, the container being positioned below the feeder tray such that the opening in the closure allows the plate member to fit inside the closure opening, the container including a body of liquid which flows through the container;

a vibrator unit which is attached to the feeder tray, for vibrating the tray and the plate member, a mixer device which is positioned in the liquid in the container, for agitating the liquid;

a circular conduit member which includes a vertical section, the vertical section having an upper end which is open, a deflector member being located inside the vertical section at the open end, the vertical section being positioned inside the container such that the deflector member is located directly below the center of the plate member, and the conduit member being filled with a liquid stream under pressure; wherein the dry particles in the hopper are delivered into the vibrating feeder tray, the particles drop through the discharge opening in the feeder tray and fall onto the plate member, the liquid stream in the conduit flows upwardly in the vertical section to strike the deflector member, the deflected stream forms a circular liquid spout which falls into the agitating liquid in the container, the particles on the plate member fall downwardly in a curtain pattern and strike the liquid spout, the liquid spout wets the particles and carries the particles into the agitating liquid, and the particles are dispersed in the agitating liquid by the mixer device.

2. The apparatus of claim 1 in which the discharge opening in the feeder tray is a circular opening, and the plate member is a circular member of slightly larger diameter than the circular opening.

3. The apparatus of claim 1 in which the particles falling from the circular plate member into the circular liquid spout define a circular curtain pattern, and the liquid in the spout strikes the falling particles at an angle of from about 10° to 20°.

4. The apparatus of claim 3 in which the liquid in the spout strikes the falling particles at an angle of 15°.

5. The apparatus of claim 1 in which the deflector member is defined by a circular pin having a cap thereon, the pin being supported in the center of the open end of the vertical conduit.

6. A method for wetting dry particles and dispersing the particles in a liquid, the method comprising the steps of:

storing a charge of dry particles in a hopper;

delivering the dry particles from the hopper into a feeder tray, the tray having a discharge opening therein and a plate member secured to the tray directly below the discharge opening;

positioning the plate member inside a closed container which is located below the feeder tray, the container including a body of liquid;

vibrating the feeder tray and plate member to cause the dry particles to drop through the discharge opening and onto the plate member;

positioning a vertical conduit section in the closed container directly below the center of the plate member, the conduit section having a deflector member fitted therein;

flowing a liquid stream upwardly through the vertical conduit to cause the stream to strike the deflector member;

discharging the deflected stream from the vertical conduit in the form of a circular liquid spout which falls into the liquid in the container;

dropping the dry particles from the plate member in the form of a circular particle curtain which strikes the liquid spout;

wetting the dry particles in the liquid spout and carrying the wetted particles into the liquid in the container;

agitating the liquid in the container to thereby disperse the wetted particles into the liquid in the container.

* * * * *